US005639021A

United States Patent [19]

Jasinski

[11] Patent Number: 5,639,021

[45] Date of Patent: Jun. 17, 1997

[54] DELIVERY CONTAINER SIGNALING SYSTEM

[76] Inventor: Timothy K. Jasinski, 38 Anne Rd., Norwood, Mass. 02062

[21] Appl. No.: 706,176

[22] Filed: Aug. 30, 1996

Related U.S. Application Data

[63] Continuation of Ser. No. 488,600, Jun. 8, 1995, abandoned.

[51] Int. Cl.[6] ..... B65D 91/00

[52] U.S. Cl. ..... 232/34; 232/17

[58] Field of Search ..... 232/39, 35, 17, 232/1 C

[56] References Cited

U.S. PATENT DOCUMENTS

| | | | |
|---|---|---|---|
| 889,727 | 6/1908 | Siegfried | 232/34 |
| 4,089,460 | 5/1978 | Mellard | 232/34 |
| 4,201,334 | 5/1980 | Janik | 232/34 |
| 4,205,778 | 6/1980 | File | 232/34 X |
| 4,877,180 | 10/1989 | Shull | 232/35 |
| 5,125,570 | 6/1992 | Jones | 232/34 |
| 5,201,465 | 4/1993 | Limehouse | 232/35 |

*Primary Examiner*—Kenneth J. Dorner
*Assistant Examiner*—Jerry Redman
*Attorney, Agent, or Firm*—John P. McGonagle

[57] ABSTRACT

A delivery container with a signaling system to indicate delivery of materials. The delivery container signaling system is comprised of a push mechanism within the container attached to a signal plate within a transparent base extending across the bottom of the delivery container and upward over the rear of the delivery container. The movement of the push mechanism rearward within the delivery container causes the enclosed signal plate rearward and upward across the container rear when delivered materials are pushed into the container against the push mechanism.

19 Claims, 7 Drawing Sheets

DELIVERY CONTAINER SIGNALING SYSTEM

This is a FWC of Ser. No. 08/488,600, filed Jun. 8, 1995, now abandoned.

BACKGROUND OF THE INVENTION

This invention relates to delivery containers generally, and in particular to a signalling system which indicates that an item has been placed in the delivery container.

It is common for mailboxes and other receptacles such as for newspapers in rural areas to be located near a street, a road, and away from a house. The distance from the house is often considerable. Without a means to practically signal that a delivery has been made to the mailbox or receptacle, a resident may be put to considerable inconvenience traveling to and from the mailbox or receptacle to determine if and when a delivery has been made.

A number of devices are known in the prior art for conveying information concerning a delivery to a mailbox or other receptacle. However, many such devices require some positive extra action on the part of the person making the delivery. Other devices rely on a front door opening to activate a signalling mechanism, or use magnets, pulleys or other mechanical arrangements that tend to be complicated, have protruding parts, are easily damaged or require frequent adjustment.

Accordingly, it is desirable to provide a mailbox or other receptacle with means for signaling that the box or receptacle contains delivered material, which means does not have protruding parts, will maintain adjustment, will be protected from damage, and does not require any special action by the mail carrier or deliverer other than placing delivered materials into the box or receptacle.

SUMMARY OF THE INVENTION

In view of the foregoing disadvantages inherent in the known types of devices now present in the prior art, the present invention provides a delivery container signaling system. As such, the general purpose of the present invention, which will be described subsequently in greater detail, is to provide a new and improved delivery container signaling system which does not rely on a front door opening, magnets, pulleys, or the like to activate the signaling mechanism. To attain this, the present invention incorporates a push mechanism within the container which raises an enclosed signal at the rear of the container when delivered materials are pushed into the container against the push mechanism.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
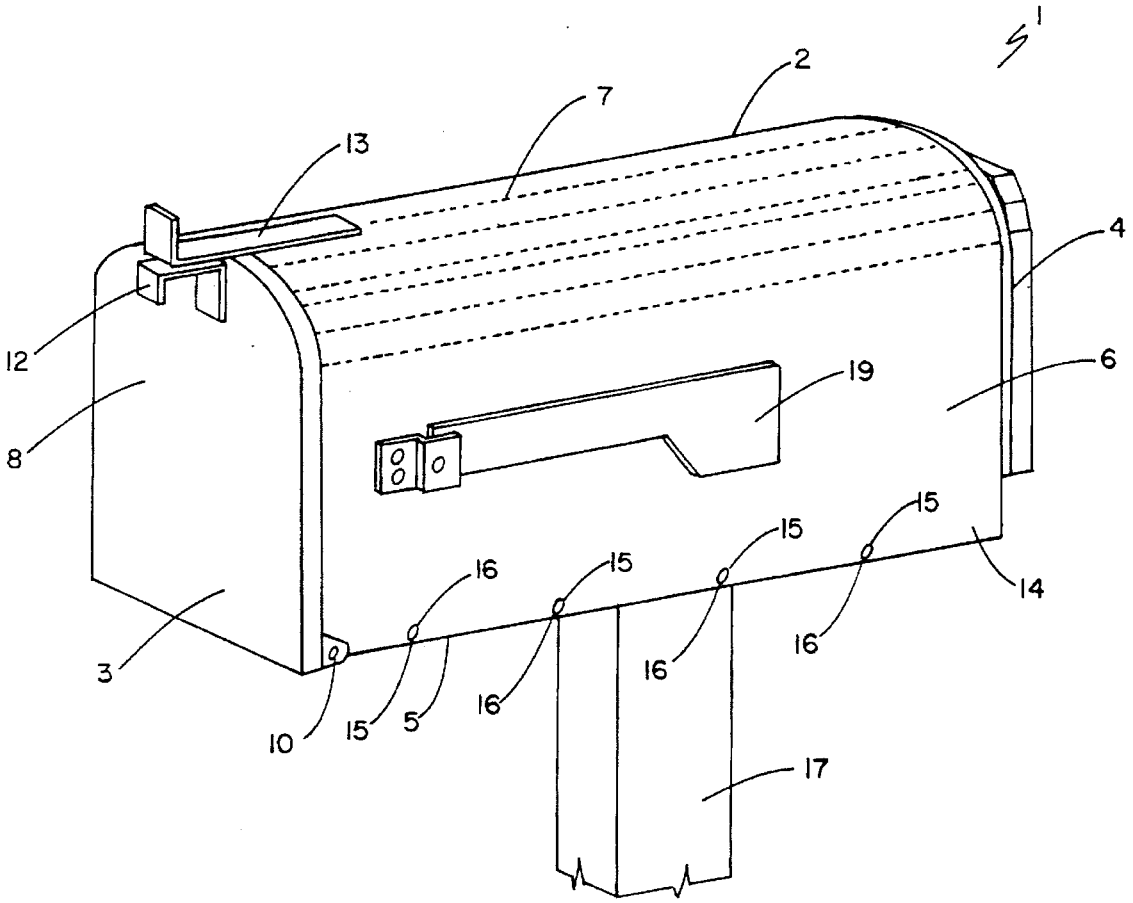
FIG. 1 is a front perspective view of the invention mounted on a post.
Figure 2B:
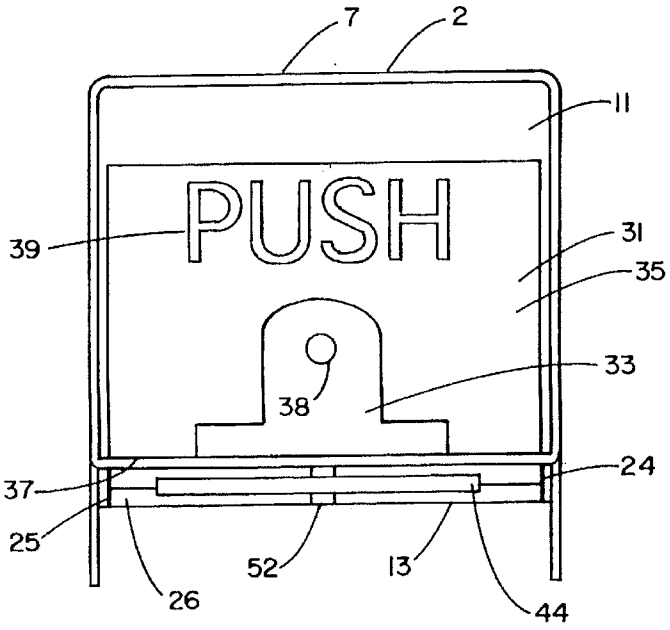
FIG. 2B is a front view of the invention configured for a newspaper-type container.
Figure 2A:
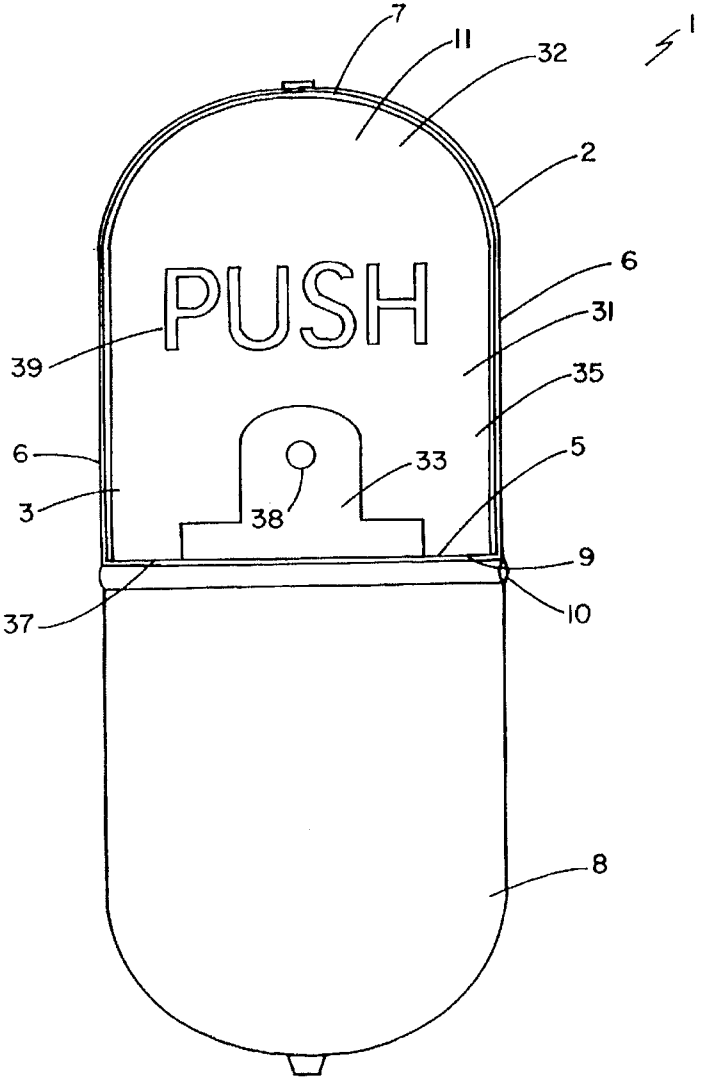
FIG. 2A is a front view of the invention configured for a mailbox-type container with the front cover open.
Figure 3:
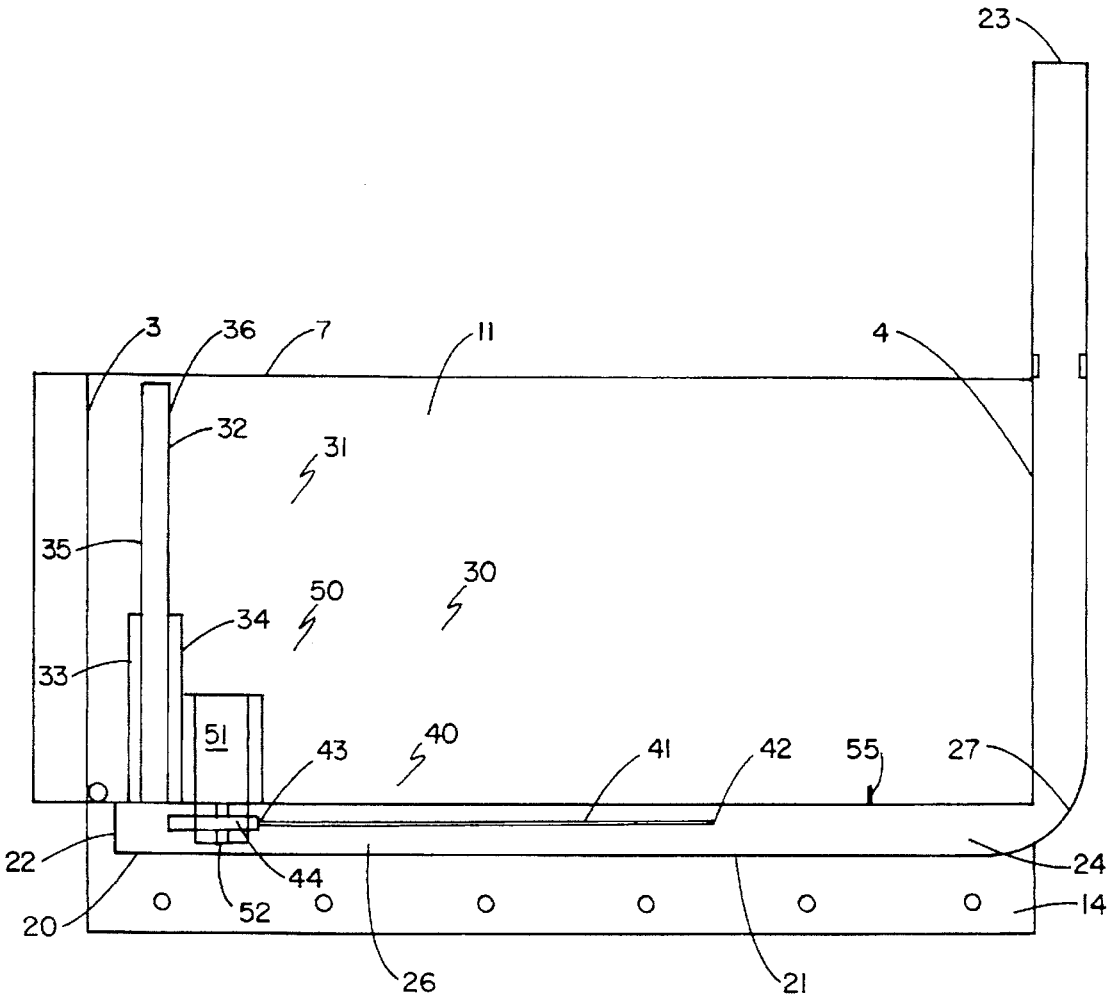
FIG. 3 is a side view of the invention, partly in section, of the invention embodiment shown in FIG. 2A.
Figure 4:
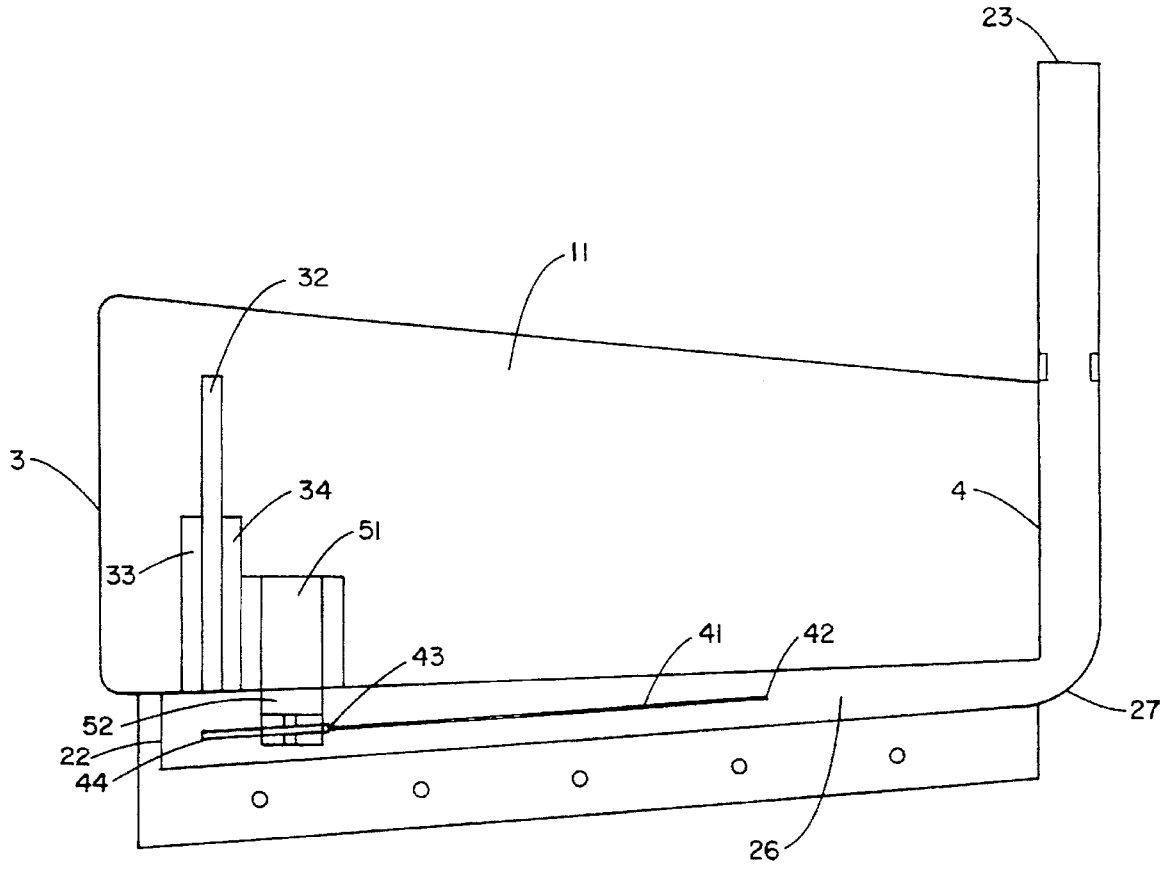
FIG. 4 is a side view of the invention, partly in section, of the invention embodiment shown in FIG. 2B.
Figure 5:
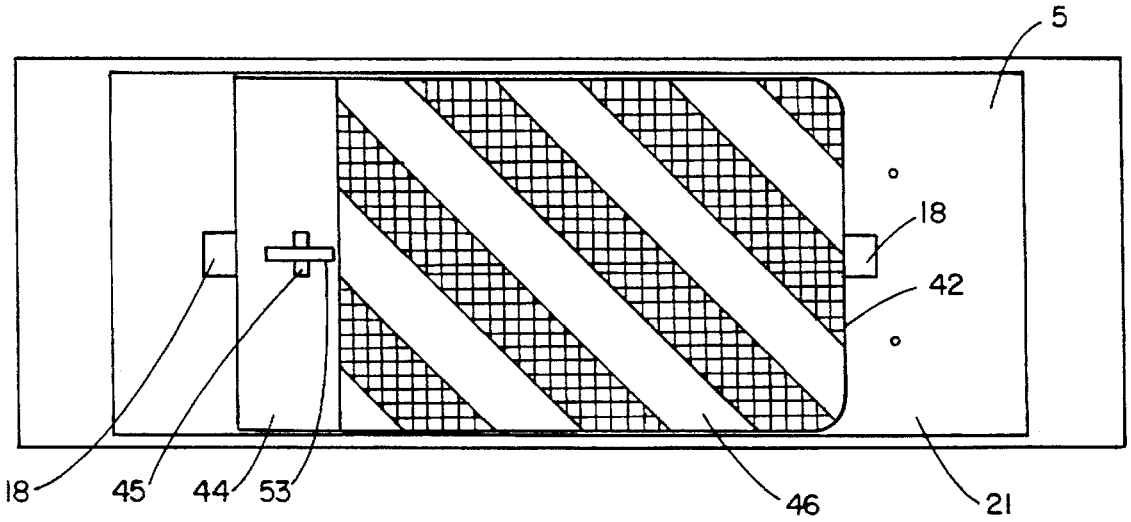
FIG. 5 is a bottom view of the invention.
Figure 6A:
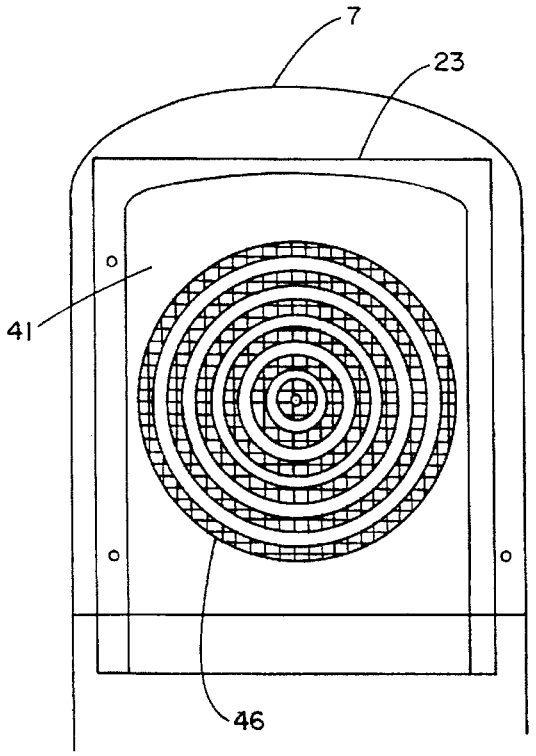
FIG. 6A is a rear view of one embodiment of the invention.
Figure 6B:
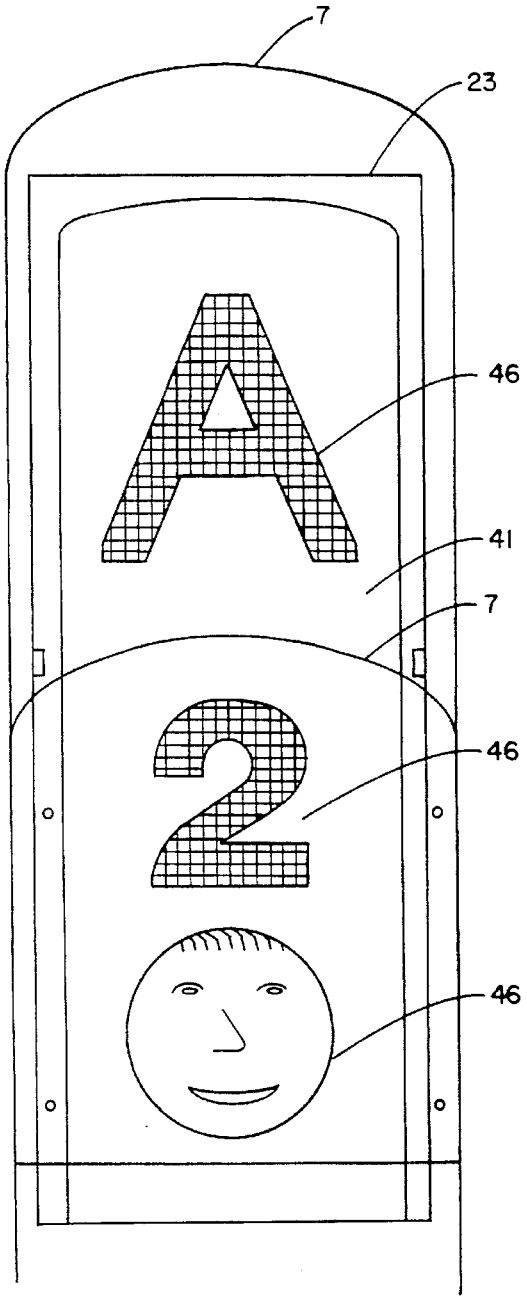
FIG. 6B is a rear view of another embodiment of the invention.
Figure 6C:
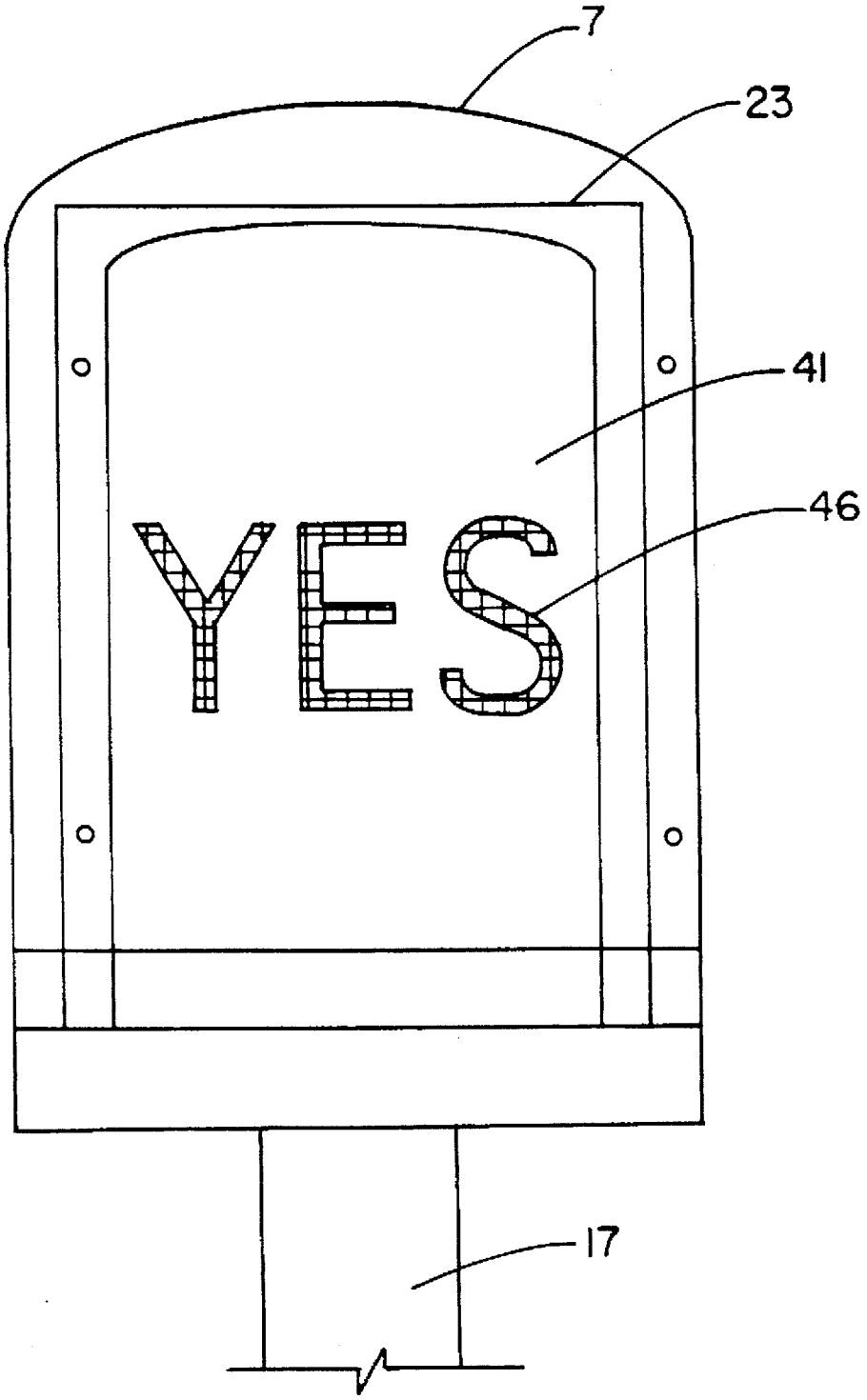
FIG. 6C is a rear view of the invention embodiment shown in FIG. 1.

Referring to the drawings in detail wherein like elements are indicated by like numerals, there is shown a delivery container 1 with a signaling system 30 constructed according to the principles of the present invention. The delivery container 1 will generally be a mailbox type (see FIGS. 1, 2A, 3, 5–6C) or a newspaper type (see FIGS. 2B and 4), although other types may be constructed according to the principles of this invention. The delivery container is comprised of a hollow, elongated housing 2, having an open front end 3, a closed back end 4, a bottom 5, opposite side walls 6 attached to said bottom 5, and a top 7 extending from one side wall 6 to the opposite side wall 6. The front end 3, back end 4, bottom 5, side walls 6 and top 7 define a housing interior 1. The container housing interior 11 has a generally horizontal, longitudinal, central axis. An elongated slot 18 is formed centrally in the delivery container housing bottom 5, said slot 18 running parallel to the container housing interior horizontal, longitudinal, central axis. The slot 18 begins near to the housing front end 3 and extends nearly to the housing back end 4. A closure member or door 8 may be mounted on the housing front end 3 adjacent a front bottom edge 9 for pivotal movement around an axis 10 between an upright position closing the container housing 2 and a down position opening the container housing 2 and providing access to the container housing interior 11 through the housing front open end 3. The closure member 8 includes a handle 12 to facilitate opening and closing the container housing 2, and an extension 13 on the housing top 7 at the housing front 3 to help retain the door 8 in its closed position. A mechanical flag 19 may also be rotatably attached to the housing side wall 6.

The container 1 is further comprised of a base 20 having a generally rectangular shape. The base 20 includes a bottom wall 21, a front side wall 22, a back side wall 23, and lateral side walls 24 and 25. The walls of the base 20 are transparent and define an internal chamber 26 which is open at the top, but which is adapted to be covered by the container housing bottom 5 when the housing 1 is mounted to the base 20. The length of the base 20 is such that the container housing front end 3 extends slightly beyond the base front side wall 22. The base 20 extends rearwardly past the container housing bottom 5 and upwardly past the container housing back end 4 so that the base back side wall 23 is positioned near to or above the container housing top 7. The base bottom wall 21 is curved as it extends rearwardly past the container housing bottom 5 and upwardly past the container housing back end 4, said curved portion being designated with the reference numeral 27.

The side 6 and back 4 walls of rural-type mailboxes usually extend slightly below the mailbox bottom 5 and define a downwardly extending skirt 14 therearound. The container 1 may be attached to a post 17 with fasteners 15 inserted through skirt openings 16 into the post 17. The base 20 is sized to be received within the skirt 4 and the container 1 is mounted on the post 17 by extending fasteners 15 through openings 16 in the skirt 14 and the base 20.

The delivery container 1 of the present invention contains a signaling system 30. The signaling system 30 has a deployed position and an undeployed position. The signaling system 30 is comprised of a push plate assembly 31 positioned in the container housing interior ii and a signal element 40 positioned within the base internal chamber 26. The push plate assembly 31 is connected to the signal element 40 by means of a connector 50.

The push plate assembly 31 is located within the housing interior 11 and is comprised of a generally flat, thin, upright plate 32 with a forward support plate 33 and a rearward support plate 34 bracing the upright plate 32 in a vertical plane transverse to the housing interior, horizontal, longitudinal, central axis. The upright plate 32 lies in a plane parallel to the closed door 8 and back end 4. The upright plate 32 is generally rectangular, extending nearly to the housing side walls 6, the housing top 7 and bottom 5. The upright plate 32 has a front face 35 facing the housing front end 3 and a rear face 36 facing the housing closed back end 4. The forward support plate 33 is attached to the upright plate front face 35 and the rearward support plate 34 is attached to the upright plate rear face 36. Both support plates 33, 34 generally have less than 60% of the height of the upright plate 32 and are positioned so that their bottom edges are coincident with the bottom edge 37 of the upright plate 32. The push plate assembly 31 may have a finger hole 38 formed centrally through the forward support plate 33, upright plate 32 and rearward support plate 34. Alternatively, a knob could be attached centrally to the forward support plate 33. The finger hole 38 or knob provide a means for moving the push plate assembly 31 forward toward the housing front end 3. The upright plate front face 35 may be colored or patterned and may have instructions imprinted thereon, such as the word "PUSH" 39. A stop element 55 may be installed near to the housing back end 4 to halt the rearward movement of the push plate assembly 31.

A connector 50 is attached to the push plate assembly rearward support plate 34. The connector 50 has a block like portion 51 attached to the push plate assembly rearward support plate 33 and a central, downwardly projecting, holding element 52 extending through the housing bottom slot 18 into the container base internal chamber 26. The downwardly projecting, holding element 52 attaches to the signaling system signal element 40 contained within the base internal chamber 26.

The signal element 40 is comprised of a thin, flat, flexible signal plate 41 having a distal end 42 and a proximal end 43. In the signal system 30 undeployed mode, the signal plate 41 lies in a plane parallel to the housing bottom 5 and base bottom wall The signal plate proximal end 43 terminates in a support element 44 with a central aperture 45 formed therein. The connector downwardly projecting, holding element 52 extends through said support element central aperture 45. The holding element 52 terminates in a crosspiece 53 thereby holding the support element 44 firmly attached to said connector 50. The signal plate 41 may be colored or patterned with any desired indicia 46.

In operation, the door 8 on the delivery container housing 2 is opened and delivered materials are inserted into the delivery container housing interior 11, thereby deploying the signaling system 30. The signaling system 30 is deployed by forcing the signaling system push plate assembly 31 rearward toward the housing back end 4. The rearward movement of the push plate assembly 31 translates a rearward movement within the base internal chamber 26 to the signal element 40 via the connector 50. As a consequence, the signal plate distal end 42 is forced toward the base back side wall 23. The signal plate 41 flexibility and the base bottom wall curve 27 permit the signal plate distal end 42 to smoothly move backward and then upward toward the base back side wall 23. The signal plate pattern 46 becomes visible through the transparent base 20 to an onlooker thereby signaling that a delivery has been made. When the delivered materials are removed from the delivery container housing interior 11, the signaling system 30 may be undeployed by pulling the push plate assembly 31 toward the housing front end 3 by means of the finger hole 38 or knob attached thereto.

It is understood that the above-described embodiment is merely illustrative of the application. Other embodiments may be readily devised by those skilled in the art which will embody the principles of the invention and fall within the spirit and scope thereof.

I claim:

1. A delivery container signaling system, comprising:

a hollow, elongated housing, having an open front end, a closed back end, a bottom, opposite side walls attached to said bottom, and a top extending from one side wall to the opposite side wall, said front end, back end, bottom, side walls and top defining a housing interior, said housing interior having a generally horizontal, longitudinal, central axis, said bottom having an elongated slot formed centrally therein, said slot running parallel to the container housing interior horizontal, longitudinal, central axis, said slot beginning near the housing front end and extending nearly to the housing back end;

a base having a generally rectangular shape, said base having a top, a bottom wall, a front side wall, a back side wall, and lateral side walls, said base walls defining an internal chamber which is open at the top, but which is adapted to be covered by the container housing bottom, said base having a length such that the container housing front end extends slightly beyond the base front side wall, said base extending rearwardly past the container housing bottom and upwardly past the container housing back end so that the base back side wall is positioned near to or above the container housing top;

a signaling system having a deployed position and an undeployed position, said signaling system being comprised of:

a push plate assembly positioned in the container housing interior and comprising:

a generally flat, thin, upright plate positioned in a plane parallel to the housing back end, said upright plate extending nearly to the housing side walls, the housing top and bottom, said upright plate having a front face facing the housing front end and a rear face facing the housing closed back end;

a forward support plate attached to the upright plate front face; and a rearward support plate attached to the upright plate rear face;

wherein said support plates brace the upright plate in a vertical plane transverse to the housing interior, horizontal, longitudinal, central axis;

a signal element positioned within the base internal chamber comprising:

a thin, flat, flexible signal plate having a distal end and a proximal end, said signal plate laying in a plane parallel to the housing bottom and base bottom wall in the signal system undeployed mode;

a support element with a central aperture formed therein, said support element attached to said signal plate proximal end; and a connector interconnecting said push plate assembly with said signal element, said connector comprising:

a block like portion attached to the push plate assembly rearward support plate;

a central holding element projecting downwardly from said block like portion, said holding element extending through the housing bottom slot into the container base internal chamber, said downwardly projecting, holding element extending through said support element central aperture, said holding element terminating in a crosspiece thereby holding the support element firmly attached to said connector.

2. A delivery container signaling system as recited in claim 1, wherein:

said base bottom wall is curved as it extends rearwardly past the container housing bottom and upwardly past the container housing back end.

3. A delivery container signaling system as recited in claim 2, wherein:

said upright plate is generally rectangular.

4. A delivery container signaling system as recited in claim 3, wherein:

said support plates generally have less than 60% of the height of the upright plate and are positioned so that their bottom edges are coincident with the bottom edge of the upright plate.

5. A delivery container signaling system as recited in claim 4, further comprising:

a means for moving the push plate assembly forward toward the housing front end.

6. A delivery container signaling system as recited in claim 5, wherein:

said base walls are transparent.

7. A delivery container signaling system as recited in claim 6, wherein:

said means for moving the push plate assembly forward toward the housing front end is a finger hole formed centrally through the forward support plate, upright plate and rearward support plate.

8. A delivery container signaling system as recited in claim 6, wherein:

said means for moving the push plate assembly forward toward the housing front end is a knob attached centrally to the forward support plate.

9. A delivery container signaling system as recited in claim 6, wherein:

the signal plate is patterned.

10. A delivery container signaling system as recited in claim 6, wherein:

the signal plate is colored.

11. A delivery container signaling system as recited in claim 6, wherein:

the signal plate contains indicia imprinted thereon.

12. A delivery container signaling system as recited in claim 6, wherein:

the upright plate front face is patterned.

13. A delivery container signaling system as recited in claim 6, wherein:

the upright plate front face is colored.

14. A delivery container signaling system as recited in claim 6, wherein:

the upright plate front face contains indicia imprinted thereon.

15. A delivery container signaling system as recited in claim 6, further comprising:

a stop element near to the housing back end adapted to halt the rearward movement of the push plate assembly.

16. A delivery container signaling system as recited in claim 15, further comprising:

a closure member mounted on the housing front end adjacent to a front bottom edge for pivotal movement around an axis between an upright position closing the container housing and a down position opening the container housing and providing access to the container housing interior through the housing front open end.

17. A delivery container signaling system as recited in claim 16, further comprising:

a handle mounted on said closure member; and an extension on the housing top at the housing front adapted to help retain the door in its closed position.

18. A delivery container signaling system as recited in claim 17, wherein:

said housing back end and side walls extend slightly below the housing bottom thereby defining a downwardly extending skirt therearound.

19. A delivery container signaling system as recited in claim 18, wherein:

said base is sized to be received within said skirt.

* * * * *